US005802863A

United States Patent [19]

Cowans

[11] Patent Number: 5,802,863

[45] Date of Patent: Sep. 8, 1998

[54] SYSTEM AND METHOD FOR REFRIGERATING LIQUIDS

[75] Inventor: Kenneth W. Cowans, Fullerton, Calif.

[73] Assignee: B/E Aerospace, Inc., Wellington, Fla.

[21] Appl. No.: 556,163

[22] Filed: Nov. 9, 1995

[51] Int. Cl.[6] ..... F25B 41/00; F25B 1/00

[52] U.S. Cl. ..... 62/211; 62/229; 165/295

[58] Field of Search ..... 62/229, 211, 66, 62/209, 259, 2; 236/78 D; 165/295

[56] References Cited

U.S. PATENT DOCUMENTS

| | | | |
|---|---|---|---|
| 4,509,586 | 4/1985 | Watabe | 62/229 A |
| 4,802,340 | 2/1989 | Johnson | 62/229 |
| 4,813,241 | 3/1989 | Hurutachi et al. | 62/209 |

*Primary Examiner*—William E. Wayner
*Attorney, Agent, or Firm*—Merchant, Gould, Smith, Edell, Welter & Schmidt

[57] ABSTRACT

A refrigerator for rapidly cooling down and then maintaining a plurality of wine bottles of arbitrary configuration within a selected temperature range comprises a compression type refrigeration unit in association with the refrigerated compartment which receives the wine bottles. The refrigeration unit includes a controllable expansion valve and a control system in which a microcontroller is arranged with a plurality of stored cooldown models as references for bringing the wine bottles to temperature without damage to the wine. Temperature, pressure and air flow measurements are used by a computer programmed to determine the status of the thermal load as affected by the number of wine bottles and their temperatures, and to adjust variations in the load compartment temperature for both cooldown modes and a steady state mode. Given an arbitrary thermal load, the refrigerator system lowers the wine temperature in a maximized but controlled manner so that chilled wine is available in no more than 30 minutes.

13 Claims, 5 Drawing Sheets

POWER UP
120
SENSE PHASE ROTATION
122
FAULT
126
CHECK COMPRESSOR AIR FLOW
124
SUPPLY AIR TEMP
130
AIR FLOW
135
RETURN AIR TEMP
131
SENSE REFRIGERANT TEMP
132
PERIODICALLY COMPUTE THERMAL LOAD
134
SELECT/CHANGE COOLDOWN MODEL
137
ADJUST REFRIGERANT SUPER HEAT TO FOLLOW MODEL TO~6.2°C
139
RUN IN STEADY STATE 4°C TO 6.2°C
141
DIAGNOSTICS
145
STORE FLIGHT DATA
143

SYSTEM AND METHOD FOR REFRIGERATING LIQUIDS

BACKGROUND OF THE INVENTION

1. Field of the Invention

This invention relates to the refrigeration of liquids susceptible to thermal damage, and more particularly to systems for passenger aircraft galleys for rapidly chilling bottled wine to a cold temperature and maintaining a chosen temperature without harming the wine.

2. Description of the Related Art

Existing techniques for chilling wine bottles on commercial aircraft generally simply immerse the wine bottles in ice containers, removing them from the ice as needed, and replenishing the supply with unchilled bottles as the flight proceeds. On large airliners carrying hundreds of passengers and flying long routes, the weight and space required to transport large amounts of ice adequate for anticipated wine service can result in significant operational costs.

While adequate electrical power is generally available for in-flight refrigeration of wine bottles, several factors complicate the problems of quickly chilling bottles to a desired temperature range and than maintaining them at a chosen temperature without damage passenger demand for wine delivery can begin shortly after take-off generally involves several intervals of accelerated consumption, e.g., during initial beverage service and before and after during meal service. Pre-refrigeration of wine bottles before loading is not permitted because bottles are kept in a bonded warehouse and released for a specific flight only under strict inventory controls. However, because demand profiles can be quite accurately predicted from the number and types of passengers, some preparatory estimates can be made. A reasonably adequate number of bottles can be started chilling prior to the initial beverage service period, with this cool-down typically beginning as soon as wine bottles are loaded into the aircraft, which is usually shortly before passengers board. Thereafter, other estimates can be made periodically of the maximum number of chilled wine bottles that should be available during the flight, during periods of surge and steady state consumption.

Typical large-capacity refrigeration systems are not feasible on passenger aircraft, where weight and space are at a premium. Small conventional refrigerators with capacity for eight to ten bottles, for example, are also not suitable because of the need for cooling down the wine in the shortest reasonable time consistent with the fragile character of the wine itself. The space used should be as small as feasible, the internal configuration should permit efficient thermal transfer, and the power required should be minimized to the extent possible. Further, the refrigerator system cannot cause the wine to approach freezing, either during cooldown or thereafter in steady state, because the wine will be damaged. While it is theoretically possible to start cool-down of a load of wine bottles at ambient temperature in a refrigerator compartment whose temperature is below freezing and then cycle to a compartment temperature above freezing as the wine temperature is lowered, this is impractical because of the probability of constant change of the contents in the compartment, i.e., the refrigerated load. For example, if four ambient temperature bottles are added to two previously cold bottles, the situation is different than if all six bottles are at ambient temperature or if five bottles are cold and one is at ambient temperature. If the compartment is full of bottles, the cooling air flow is impeded more than if there are fewer bottles. The arbitrary changes in loading and use conditions make it difficult to optimize cooldown rates.

Because flight attendants cannot be expected to exercise the complex monitoring and control functions necessary to adjust for different operating conditions as they occur, an onboard refrigeration system must be substantially if not totally automated. Moreover, to meet power and volume constraints, it must also be energy efficient and compact in size.

SUMMARY OF THE INVENTION

A refrigeration system for rapidly cooling down and maintaining a variable plurality of wine bottles within a 4.0°–6.2° C. temperature range in a load compartment includes a compression-type refrigeration unit and a control system which senses dynamic thermal conditions and flow rates to determine thermal load conditions as represented by the number of bottles and their temperature status. It then regulates the cooling derived from air flows in accordance with cooldown models stored in memory to establish optimized pulldown rates which do not endanger the wine regardless of the temperature of the contents of individual bottles. Changes in thermal load conditions are monitored and if changes occur, a new cooldown model is selected. Once the desired temperature range is reached, the system maintains the temperature in that range.

The system measures temperatures, pressures and air flows to monitor thermal load and refrigerant temparature, providing inputs to a microcontroller which controls refrigeration rate, by adjusting refrigerant expansion prior to an evaporator which cools the chilled air fed into the wine compartment. The system can shift from one cooldown model to another as wine bottles are added or removed, adjusting for the instant thermal load requirements and air flow impedance. A full load of ambient temperature bottles can, in this compactly configured system, be brought to the desired temperature range in 30 minutes.

The control system includes a microcontroller including two input ports, two input/output ports, two output ports, an analog-to-digital converter, an EPROM functioning as a control program storage device, and an EEPROM functioning as a data storage device. Temperature, pressure, and air flow rate sensor measurements that are input to the microcontroller are digitized and used in selection of a cooldown program. Control signals to an expansion valve included in the refrigerant line after the compressor determine the refrigerant temperature level established for chilling air flow through the wine bottle compartment. Measurements are also used by the microcontroller to selectively enable and disable subunits within the refrigeration unit to ensure proper operation and prevent damage. The thermal transfer between refrigerating air moving through the compartment and the wine bottles is regulated such that, regardless of the number and temperature of the wine bottles, the cooldown rate is optimized but does not take the cold bottles into a temperature range that would damage the wine.

BRIEF DESCRIPTION OF THE DRAWINGS

A better understanding of the present invention will be gained by consideration of the following description, taken in conjunction with the accompanying drawings, in which.

DETAILED DESCRIPTION OF THE INVENTION

Figure 1:
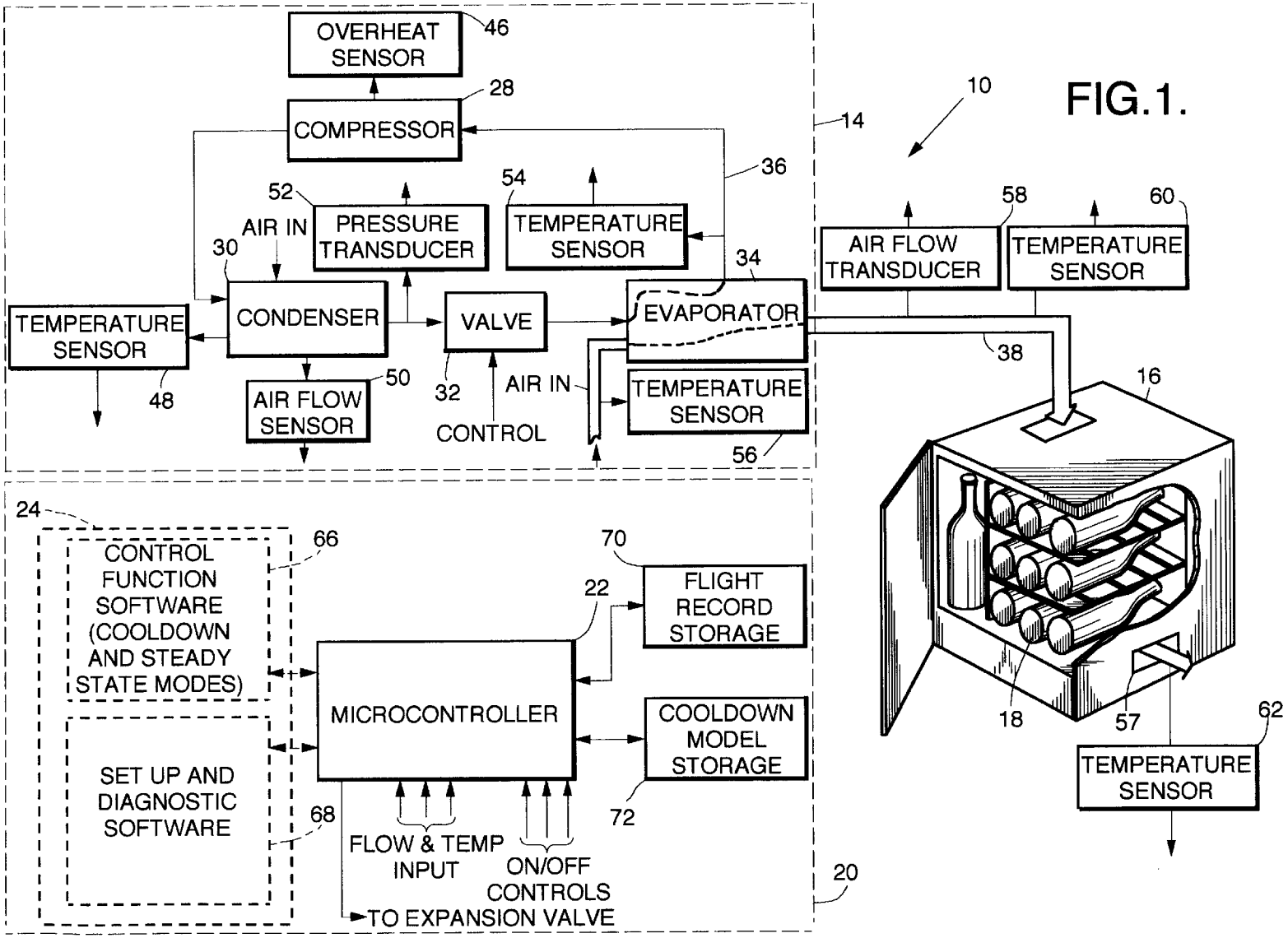
FIG. 1 is a combined block diagram and perspective view of a refrigeration unit and control system in accordance with the present invention.

Referring now to FIG. 1, a refrigeration system 10 in accordance with the invention includes an electromechanical refrigeration unit 14 which supplies chilled air to a refrigerated load compartment 16 in which a number of bottles may be disposed in horizontal or vertical orientation, the vertical position typically being used after the bottles have been opened. The wine bottles will be of arbitrary combination, by which is meant that either or both the number of bottles and their temperature levels can be varied without restriction, within reasonable limits. Here the maximum capacity, depending upon the design, is typically designed to receive 8–12 bottles. The initial bottle temperature on loading will usually be the ambient temperature for the geographic region in which they are retained in a bonded warehouse. The control system 20 for operating the refrigeration unit 14 includes a digital microcontroller 22 operating in accordance with control programs 24 which are described in greater detail hereafter.

The refrigeration unit 14 is a compact and light weight unit, but operating on conventional compression principles. It includes a compressor 28, a condenser 30 and expansion valve 32 and an evaporator 34 coupled in a closed loop refrigerant line 36. Cold air that is produced by driving air across the evaporator 34 and the refrigeration unit 14 is transported via an air duct 38 into the refrigerated load compartment 16 and across the wine bottles 18. The compressor 28 is driven by an electric motor (not shown in FIG. 1) and functions to pressurize the refrigerant, which has been expanded to gas phase after thermal interchange with air moving into the load compartment 16. The refrigerant may be one of the commercially available and environmentally sound types, such as R-134A. An overheat sensor 46 in association with the compressor 28 monitors the temperature and generates a corresponding analog signal for the control system 20, to enable shutdown or diagnostic routines if the temperature exceeds a predetermined limit.

In the refrigeration unit 14, high pressure fluid from the compressor 28 is input to the condenser 30 where, as a result of heat loss taking place in the condenser, the pressurized refrigerant is condensed into a high pressure liquid. The condenser 30 typically includes a relay operated condenser fan (not shown) which directs ambient air through the condenser 30 to extract thermal energy from the refrigerant. A temperature sensor 48 and an air flow sensor 50 coupled to the condenser 30 measure, respectively, the air temperature and flow rate at the condenser 30, generating corresponding analog signals. A pressure transducer 52 coupled to the refrigerant line 36 between the condenser 30 and the expansion valve 32 measures the pressure of the liquified refrigerant exiting the condenser 30. The expansion valve 32 may be any type of variable size orifice device or capillary tube control now commercially available for refrigeration systems. In the variable orifice type device, a valve needle is typically movable in controlled relation to a deformable element such as a bimetallic strip. A control signal applied to a heater associated with the bimetallic strip controls curvature of the strip, and therefore the position of the needle in relation to the orifice, thus adjusting the refrigerant flow rate. In passing through the orifice in the valve 32, therefore, liquid refrigerant in the line 36 expands and cools, taking up heat from the air that is input to the evaporator 34. Increasing the control temperature applied to the valve 32 decreases output refrigerant flow and therefore the temperature of the cooling air, while decreasing the temperature of the heater has the reverse effect. For a stable system operation, the control system 30 seeks to maintain the temperature of the wine in the range of 4° C. to 6.2° C.

A temperature sensor 54 is coupled into the refrigerant line 36 at the refrigerant output from the evaporator to provide an analog signal for the control system 20 of the refrigerant temperature at that point. Using this and other signals, the temperature is not allowed to drop below a chosen level, such as −5° C. to 0° C. The temperature of air flowing into the evaporator 34 is monitored by a temperature sensor 56, with the resultant analog signal being supplied to the control system 20.

From the evaporator 34, the refrigerant, now at a higher temperature level, after interchange of thermal energy with input air, returns to the compressor 28 by the refrigerant line 36, completing the refrigeration cycle. Evaporator 34 is in close proximity to the refrigerated load compartment 16 and the air duct 38, along which chilled air moves, is also relatively short. A fan (not shown) is typically disposed at the air intake to assist flow of chilled air into the compartment 16. Air flow out of the compartment 16 is via an exit port 57, after the cooling air has moved across the wine bottles 18 in heat exchange relation. Either air recirculation or an open air input to the evaporator 34 may be used, as desired.

Air flow in the air duct 38 after the evaporator 34 is sensed by an air flow transducer 58, and the resultant analog signal is applied to the control system 20. Also, the temperature of the cold air in the air duct 38 is derived at a temperature sensor 60, while air exiting the refrigerated compartment 16 is sensed for temperature at an air outlet temperature sensor 62 All sensor signals are applied to the control system 20. These signals enable determination of the rate of thermal energy change in the load compartment 16.

In the control system 20, the microcontroller 22 receives the various temperature, pressure and air flow signals and generates control signals for adjustment of controllable parameters so as to operate the system in both transient and steady states. Additionally, other signals indicative of pressure levels, flow rates and operating conditions of different functional elements in the refrigeration unit 14 are also monitored and used for diagnostic control and control purposes. Monitoring functions, such as sensing overheat and overpressure conditions, are useful to the system and conveniently controlled by the microcontroller 22 as the primary wine cooling procedures are carried out, but are not significant to the inventive aspects and are therefore not described in detail.

The control programs 24 include control function software 66 for governing the cool down and steady state modes of the system, and set up and diagnostic software 68 for initiating operations, initially checking the performance of units and monitoring for satisfactory operation. The former software sequences are described in more detail in conjunction with FIG. 3, but the set up and diagnostic software pertain to the more routine details of operation and specifics are therefore omitted in the interests of brevity. Also employed in conjunction with the microcontroller 22 is a flight record storage 70, which in this example is utilized to record flight data as to conditions of operation on a running basis. The operating conditions during the last eight flights, for example, can be analyzed, particularly in the event of a failure or other problem. A separate storage 72, which provides a number of cool down models for reference to the microcontroller 22 enables the microcontroller 22 to have ready reference to predetermined control conditions desirable for whatever arbitrary number of bottles are inserted in the load compartment 16.

Figure 2:
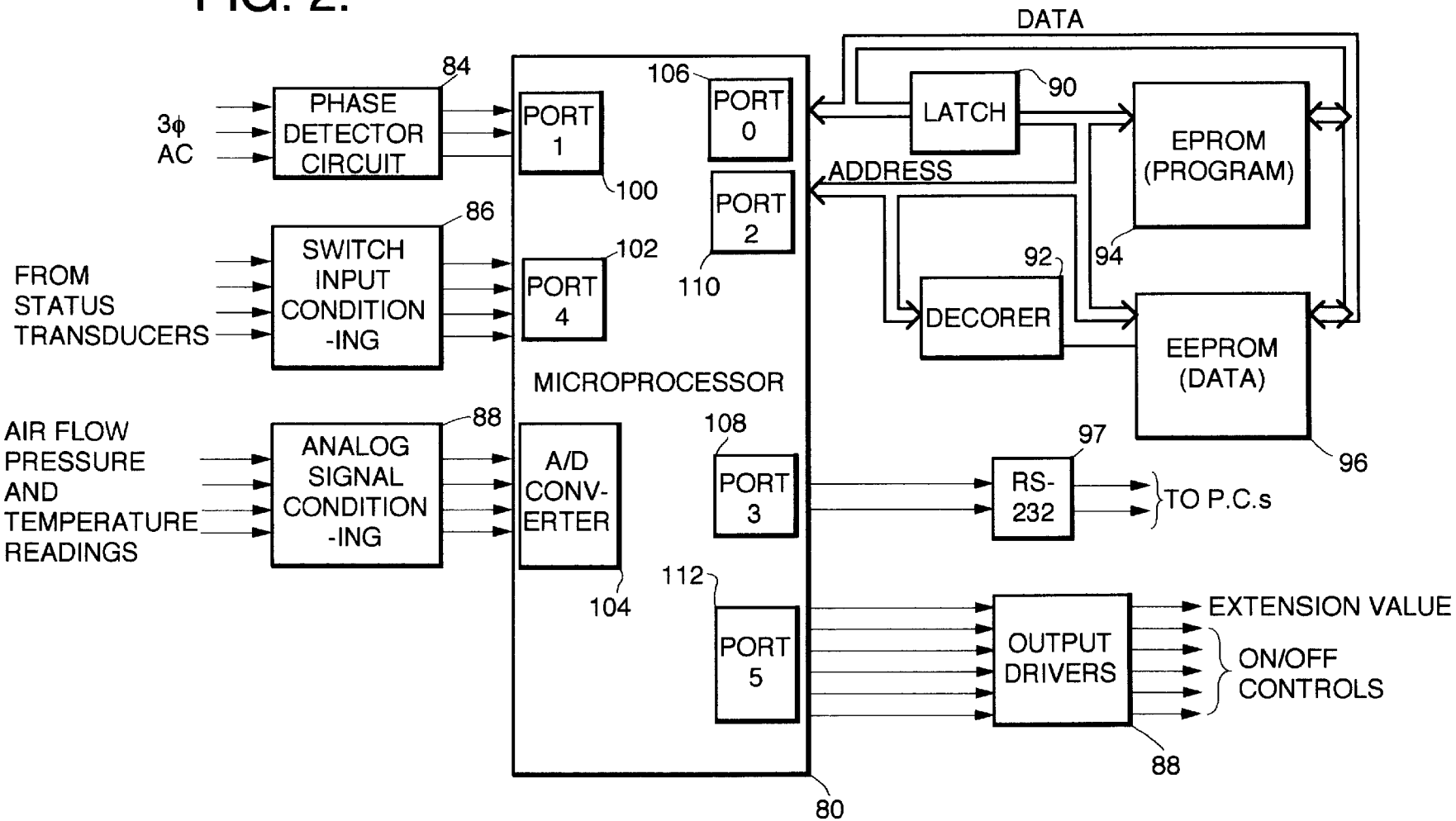
FIG. 2 is a block diagram of the control system of FIG. 1.

Referring to FIG. 2, the details shown of the control circuits 20 and microcontroller 22 include some reference to the warning and safety features used in the system that are mentioned for completeness but not omitted for brevity because they are not germane to the inventive concept. The microcontroller 22 in this example may be of the type that has been available for a number of years as part no. 87C51GB from Acurex Corp., assignee of the present invention. This unit is based upon a microprocessor 80 and associated circuits such as a phase detection circuit 84, a switch input conditioner circuit 86, an analog signal conditioner circuit 88, a latch 90 and a decoder 92. The latch 90 communicates between the microprocessor 80 and an EPROM 94 functioning as a control program storage device, while the decoder 92 is in circuit between the microprocessor 80 and an EEPROM 96 functioning as a data storage device Additional circuits coupled to the microprocessor 80 are an RS-232 cable interface 97 and an output drive circuit 98, which provides signals to control a thermal expansion valve and a number of on/off elements, such as lamps, compressor, condenser and evaporator relays and fans.

The microprocessor 80 of the type described operates with a 12 Mhz crystal and includes a first input port ("PORT1S") 100, a second input port ("PORT4") 102, an analog-to-digital (A/D) converter 104, a first input/output port ("PORT0") 106, a second input/output port ("PORT3") 108, a first output port ("PORT2") 110, and a second output port ("PORT5") 112. These are connected to various of the other circuits as described hereafter.

The phase detection circuit 84 measures the phases of 400 Hz three-phase alternating current at 208 volts, received as inputs, and in turn sends digital signals representing the phase states to pins of the first input port 100. After the required relative phase relationships have been established, as recognized by the microprocessor 80, the system is enabled for performing control sequences. The switch input conditioner 86 includes A/D conversion circuits to generate digital signals from the analog input signals from various status transducers of FIG. 1. The digitized signals are sent to the second input port 102 of the microprocessor 80. A different set of signals are applied to an A to D converter 104 in the microprocessor 80, from the analog signal conditioner. These are signals as to the temperature of air supplied to and returned from the load, the air temperature at the compressor, the evaporator coil temperature, the compressor air flow, and the pressure level measured by the sensor. The analog signal conditioner circuits 88 provide the necessary gain and signal adjustments for the A to D converter 104.

In the microprocessor 80, the port 106 is in two-way 8-byte parallel communication with the latch 90 via a multiline bus, and also into a 8-byte parallel data communication with EPROM 94 and EEPROM 96, for data communication. The port 110 transmits address information to the decoder 92, the EPROM 94 and the EEPROM 96 via another multiline bus. This portion of the system enables reference to preentered cooldown models and retention of flight data in the running storage.

An output port 108 coupled to the RS-232 interface 97 enables communication to an output device, such as a computer or display. Control signals for the thermal expansion valve are generated at the port 112 designated as "PORT 5" and applied through the output drive circuits 98, along with the lamp, relay and other switches on other terminals.

Figure 3:
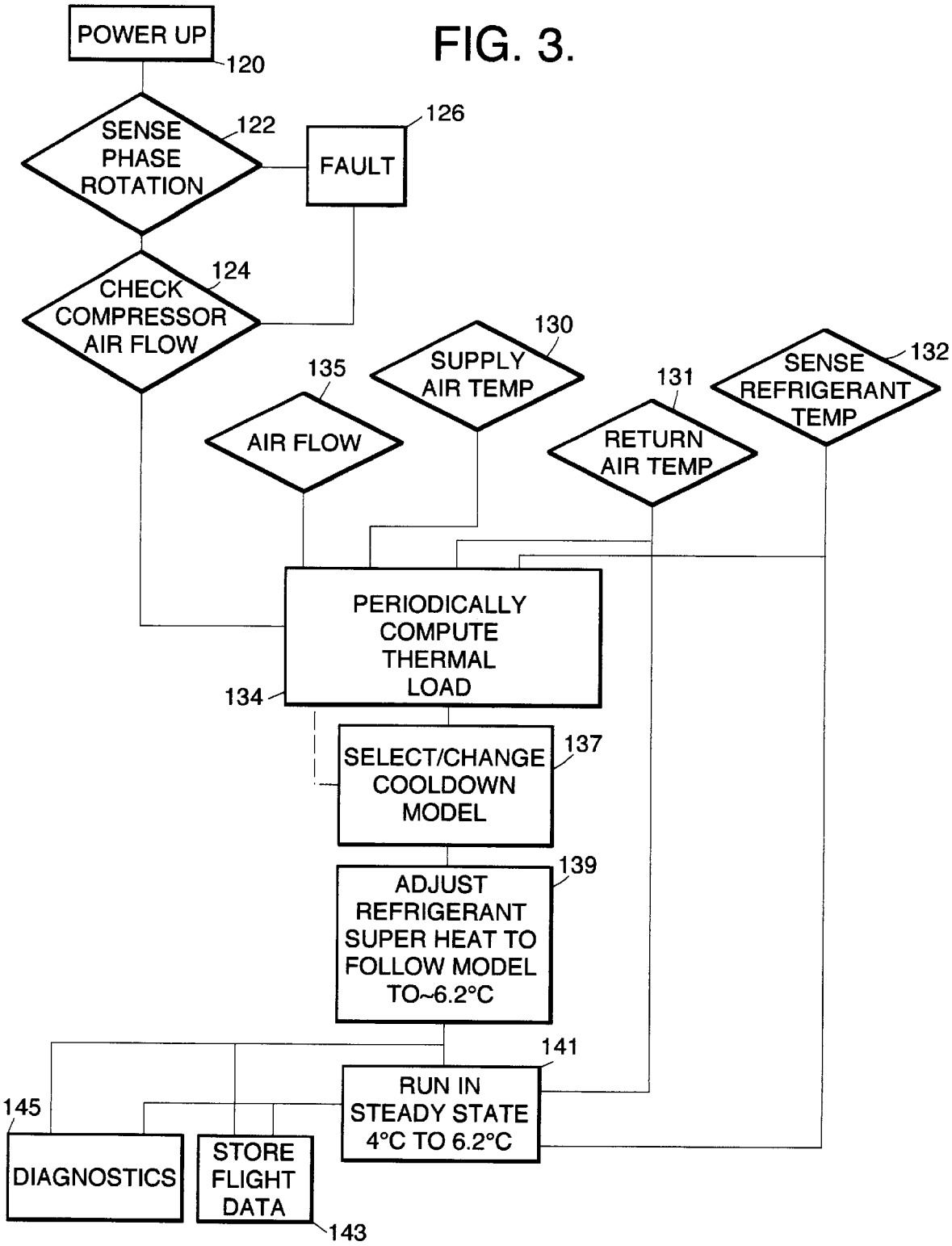
FIG. 3 is a block diagram showing steps employed in control of wine temperature, in the system of FIGS. 1 and 2.

FIG. 3 depicts the principal operational control sequence used in the microcontroller 20 of FIGS. 1 and 2. After initial power up, in step 120, the system operates to turn on and check various units in the refrigeration system 10, such as the compressor, fans, lamps and operating conditions, primarily temperatures and air flows. Inasmuch as these are secondary subroutines, they are not further discussed except with respect to sensing of phase rotation 122 and checking of condenser 124, added to depict the general nature of said such subroutines. If either condition is incorrect, a fault indication 126 is generated. The same is done in checking for satisfactory status of other parts and functions of the system of FIG. 1.

The control routines in the microcontroller 20 follow the sequence generally depicted in FIG. 3. Three inputs basically are used for determining the thermal load in the refrigerated compartment. Two of the three sensed conditions are the supply air temperature to the refrigerated compartment, at step 130, and the return air or outlet air temperature sensed in the step 131. The refrigerant temperature is also separately sensed in the step 132. The refrigerant temperature is sensed after the evaporator 34, after the input air has been cooled. The two air temparature readings are continually sensed, and periodically polled, to compute the thermal load in a step 134 by also, using the air flow input value shown as a separate step 135. Thermal energy exchange between the refrigerant and the air used for chilling determines the input temperature of air into the refrigerated compartment, which in this example is held below freezing but only at temperature below −5° C. This is to ensure that during cooldown a wide temperature differential between ambient bottles and bottles that had previously been well refrigerated does not cause overcooling of the refrigerated bottles. The calculation of thermal load is conventional, since the volume of air per unit time and the temperature differential between input and output air will be a measure of the amount of heat extracted, i.e., the number of bottles and the wine volume that is represented by the bottles. What is not known from this information is the combination of temperatures represented by the bottles.

Figure 4:
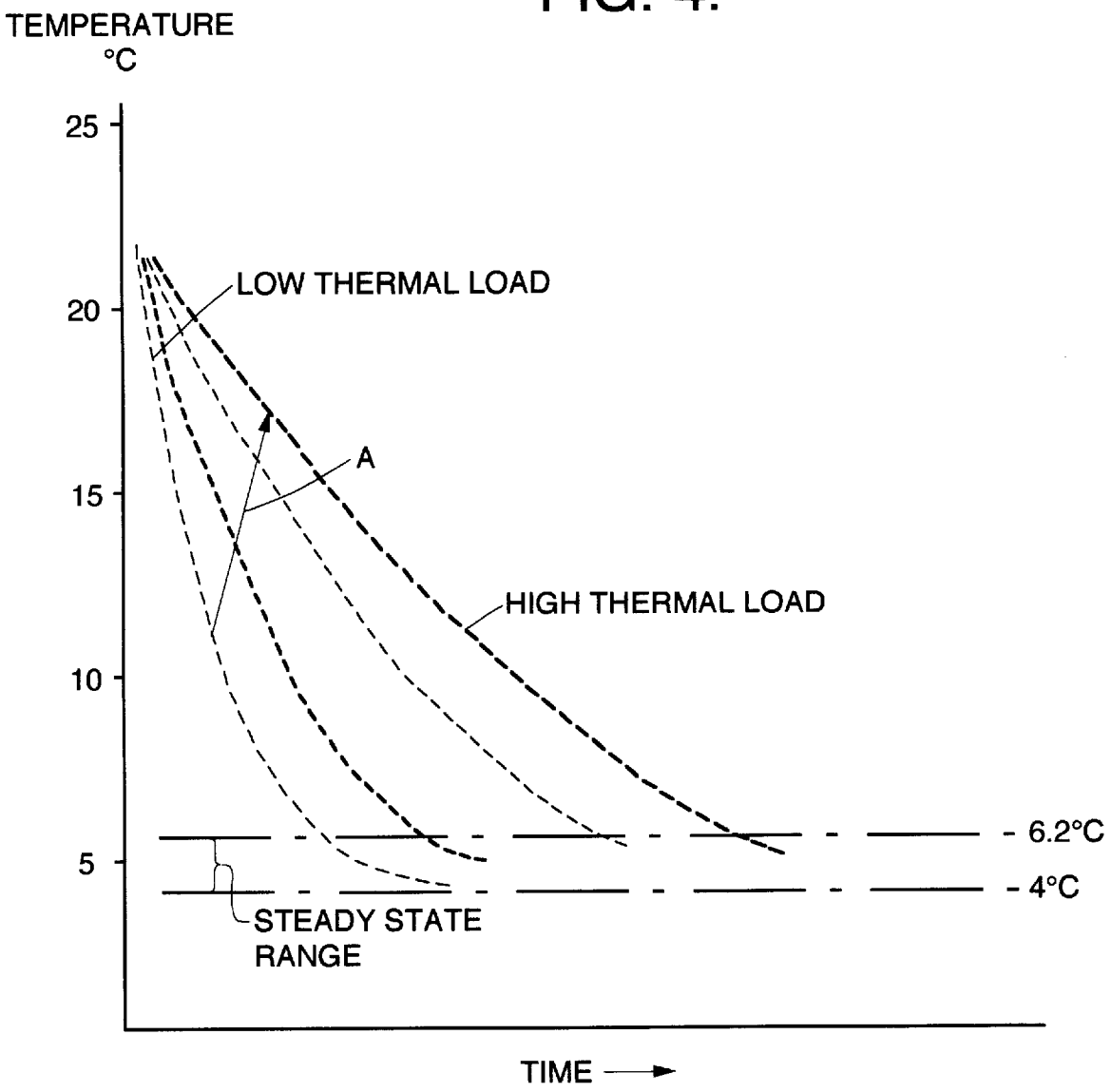
FIG. 4 is a graphical representation of exemplary temperature cooldown models stored and utilized in the system of FIGS. 1 and 2.

Given these circumstances, referring now to FIG. 4, the slope of a time-temperature curve for cooling down the wine temperature at an ideal rate is represented by one of the dotted line curves of FIG. 4. Where the thermal load is smallest, the cooldown rate can be highest until the selected temperature range is approached. Here that range is chosen as 4° C. to 6.2° C. However, in cooling the wine it cannot overshoot into the freezing region, so that the cooldown curves decrease in slope as they approach this range. At higher thermal loads, the initial slope is greater and if the initial temperature is well above the chosen range, then the system can operate at maximum refrigeration rate. In periodically computing the thermal load in the step 134, therefore, essentially the same computation result is obtained as long as the number of bottles, and their temperatures remain unchanged. In the next step of selecting a cooldown model 137, from the data in the storage 72 of FIG. 1, the system uses the time varying parameters prescribed by the cooldown model to adjust refrigerant superheat so as to follow the cooldown model in a step 139

If bottles are removed, added or exchanged, however, the polling of the sensors reveals a change in the thermal load and the temperature, as shown at "A" in FIG. 4, consequently the selection of the cooldown model, step 137, will cause a shift to a different model, which will usually start at a higher temperature as shown in FIG. 4.

In the present example, control of the expansion valve 32, and consequent adjustment of refrigerant temparature, is the primary thermal variable in the system because air flow variation, which is dependent upon the number of bottles in the refrigerated compartment, is less conveniently controllable. In addition, this enables a conventional but compact and light weight compressor type refrigerator to be used, a significant factor because of its reliability and long life. It is recognized, however, that other control approaches, including control of the air flow rate, can be used, or that a different type of a refrigerator with a different form of control, such as a thermoelectric unit, could be used given a need to sacrifice refrigeration efficiency for space, or some other consideration.

After the temperature has been brought down by tracking the cooldown model chosen, as seen in FIG. 4, then the system converts to a steady state or servo mode operation in a step 141, wherein refrigerant temperature is controlled to maintain the refrigerated load compartment and its contents in the range 4° C. to 6.2° C. In the usual situation, the system will reach a steady state temperature within a target time but cold bottles will be taken out for use and replaced by new ones at ambient temperature as long as the flight continues. Consequently, the flight history will vary between steady state and various cooldown modes over a lengthy period of use.

As data are accumulated in real time during operation, they are also transferred to the microcontroller 20 of FIG. 1 to store flight data in a step 143 and to feed the data to the control function software 66 of FIG. 1 in a diagnostic step 145. In a practical example, the EEPROM 96 of FIG. 2 is divided into 8 "banks" with data from different flights being stored in the successive banks. Data from a ninth flight is then overridden at the first bank so that a running record is obtained of the most recent flights.

Figure 5:
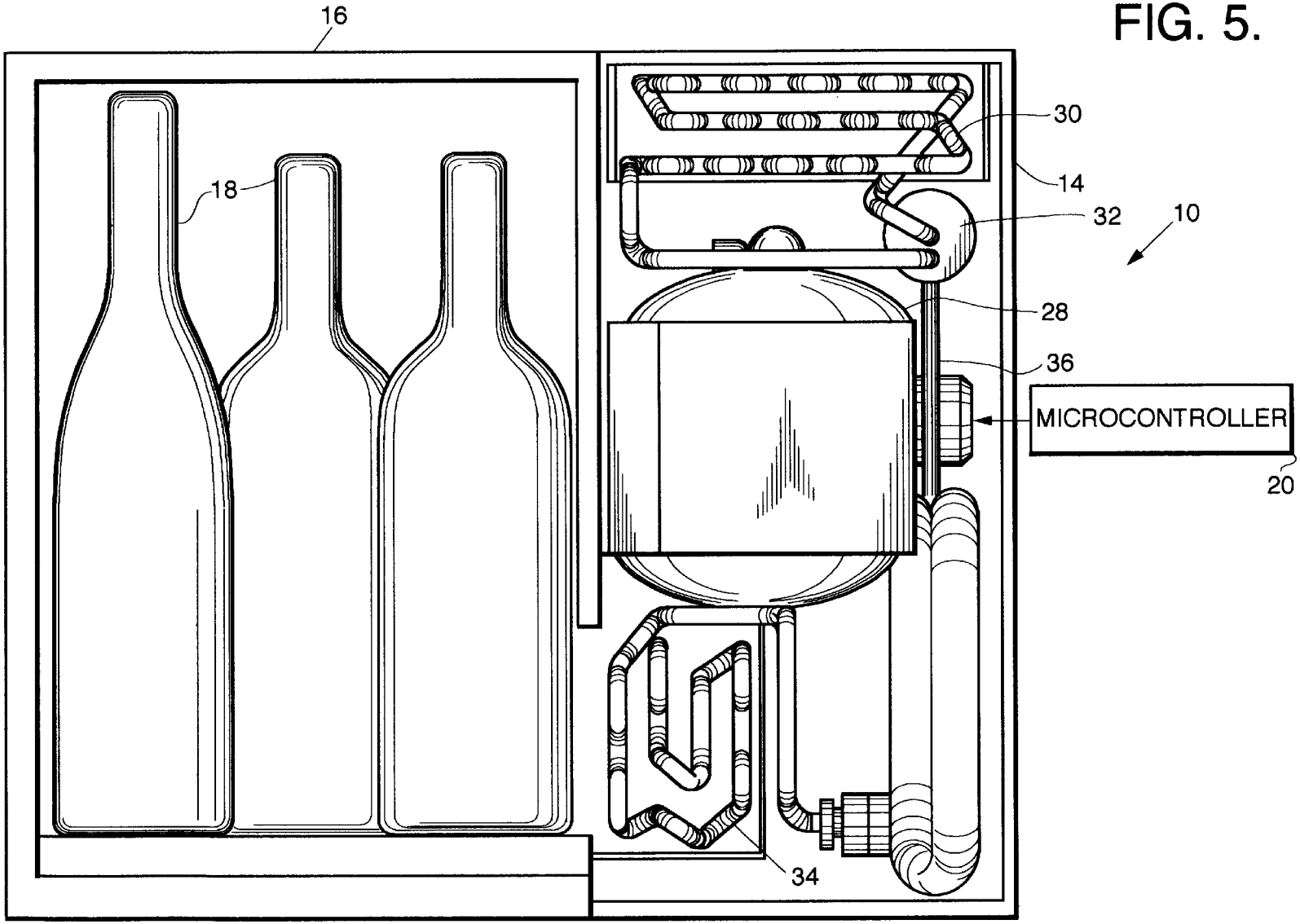
FIG. 5 is a side view, with front panels removed, of a compact refrigeration system for cooling wine bottles in accordance with the invention.

The side view of FIG. 5 generally depicts the arrangement of the interior of a compact system in accordance with the invention. Here, a small refrigerated compartment 16 adequate for twelve bottles 18, is shown as one part of the overall refrigeration system 10. The refrigeration unit 14 is disposed in side-by-side relation to the refrigerated load compartment 16, with its compressor 28 in the mid region, the coils of the condenser 30 being uppermost, so that air flow is along an unrestricted path as it is impelled to the exterior by a fan (not shown). The coils of the evaporator 34 are below the compressor 28, and adjacent a port into the refrigerated compartment 16, so that heat exchange with refrigerant in the refrigerant line 36, after expansion in the expansion valve 32, results in cooling of the evaporator 34 surface, and transfer of the chilled air into the refrigerated load compartment 16.

This unit therefore thus not only has the advantages of compactness and light weight and can be employed during long flights with large passenger loads, but is a great convenience for the aircrew as well. On a daily use basis, minimal maintenance is required.

While there have been described above and illustrated in the drawings various forms and modifications of the invention, it will be appreciated that the invention is not limited thereto but encompasses all expedients within the scope of the appended claims.

What is claimed is:

1. The method of rapidly cooling wine in bottles of unpredictably different temperatures and numbers without damaging the wine comprising the steps of:

placing the wine bottles in a confined volume;

cooling a refrigerant to a variable temperature level;

passing refrigerating air after thermal exchange relation with the cooled refrigerant into the confined volume;

measuring the air flow rate and temperature levels of incoming and outgoing air within the volume;

computing thermal load conditions in the confined volume from the measured air flow rate and temperature levels in the volume;

selecting a predetermined cooldown model for the temperature of wine in the bottles in accordance with predetermined criteria based on the computed thermal load condition;

varying the temperature in the confined volume such that the temperature follows the cooldown model; and continuing to sense thermal load conditions and selecting different cooldown models in the event of change of the thermal load.

2. The method of claim 1 above, wherein the variation of temperature is accomplished by varying the temperature of the refrigerant, and wherein the method further includes the step of maintaining temperature in the confined volume within a predetermined range above the level at which wine will be damaged once a lower limit of the cooldown model has been reached.

3. The method of claim 2 above, wherein the cooldown models reference values of temperature variations with time and the method includes the further steps of storing the reference values and storing data as to conditions of operation for record purposes.

4. The method of cooling liquids having a critical temperature range rapidly to a selected temperature range close to the critical range without damaging the liquids, the liquids being in containers, comprising the steps of:

confining the containers within a refrigeration volume, the number and temperature of the containers being variable within limits;

cooling a refrigerant to a temperature level below the critical range;

moving air through the predetermined volume about the containers;

extracting heat from air within the volume by passing the air in heat exchange relationship to the cooled refrigerant;

monitoring the temperature level of input air to the refrigeration volume;

monitoring the temperature level of output air from the refrigeration volume;

monitoring the flow rate of the air in the refrigeration volume;

computing the thermal load of the containers and contained liquids in the volume from the temperatures and flow rates of the air moving through the refrigeration volume;

storing a number of temperature reduction models each for a different thermal load condition;

selecting one of the temperature reduction models in accordance with the computed thermal load;

modulating the temperature of the refrigerant in accordance with the temperature reduction model until the output air temperature reaches a predetermined relation to the selected temperature range;

thereafter varying the refrigerant temperature to maintain the temperature in a selected steady state range; and repeating the sequence with a new temperature reduction model when a change in the thermal load is introduced.

5. The method of claim 4 above, wherein the liquids comprise wine, and the modulating of refrigerant temperature comprises varying the superheat level and wherein the selected steady state range is 4° C. to 6.2° C.

6. A system for cooling wine in bottles of unpredictably different temperatures rapidly but without damaging the wine comprising:

means providing a confined volume for receiving the wine bottles;

means for cooling a refrigerant to a variable temperature level below a critical range for the wine;

means for passing refrigerating air in thermal exchange relation with cooled refrigerant into the confined volume;

means for determining the thermal load represented by the bottles in the confined volume;

storage means maintaining a number of models for cooling down the wine in controlled fashion in accordance with predetermined criteria based on the thermal load;

means responsive to the determination of thermal load conditions for selecting a model for operation;

means for varying the refrigerant temperature to vary the temperature in the confined volume in accordance with the selected model; and means responsive to the thermal load in the confined volume for selecting a different cooldown model in the event the thermal load changes.

7. A system as set forth in claim 6 above, wherein the means for determining the thermal load comprises a microcontroller and the storage means comprises a data memory.

8. A system as set forth in claim 7 above, wherein the means for determining the thermal load further comprises air flow means and temperature sensor means disposed in the path of refrigerating air moving through the confined volume and coupled to the microcontroller.

9. A refrigeration system for cooling bottles of wine disposed within an enclosure comprising:

expansion valve means receiving a liquid refrigerant at high pressure level for expanding the refrigerant from the high pressure level liquid to a low pressure level liquid with consequent lowering of temperature;

evaporator means receiving the low pressure level liquid from the expansion means for at least partially evaporating the low pressure liquid;

air flow means in communication with the evaporator means for removing heat from the enclosure as the liquid evaporates creating inlet chilled air and low pressure level gas;

compressor means receiving the low pressure level gas for compressing the low pressure level gas creating a high level pressure gas and increasing the temperature of the gas;

condenser means receiving the high pressure level gas for condensing the high pressure level gas creating high pressure level gas creating high pressure liquid and outlet air as the gas condenses;

means for recirculating the high pressure liquid to the expansion means;

means for monitoring the temperature of the inlet chilled air, the outlet air, and the air flow to the enclosure; and microprocessor means responsive to the monitored temperatures of the inlet air and the outlet chilled air for modulating the setting of the expansion valve means in accordance with a time variable temperature profile, to establish a selected change of the wine with time.

10. The invention as set forth in claim 9, further comprising modelling means for storing a plurality of temperature reduction models.

11. The invention as set forth in claim 10, wherein the microprocessor means further comprises means for calculating the thermal load represented by the wine containing bottles based on the monitored temperatures and flow.

12. The invention as set forth in claim 11, wherein the microprocessor means selects one of the plurality of temperature reduction models based on the thermal load for modulating the setting of the expansion valve means to thereby control the temperature in the enclosure.

13. A refrigeration system for rapidly cooling wine having a critical temperature range to a selected temperature level close to the critical range without damaging the wine, the wine being disposed in bottles, comprising:

means for confining the wine in the bottles within a predetermined known volume located within the refrigeration system, the number and temperature of the bottles being variable;

means for cooling a refrigerant to a temperature level below the critical range;

means for moving air through the predetermined volume about the bottles;

means for extracting heat from air within the volume by passing the air in heat exchange relationship to the cooled refrigerant;

means for monitoring the temperature level of input air to the volume;

means for monitoring the temperature level of output air from the volume;

means for monitoring the air flow;

means responsive to the monitored values for computing the thermal load of the wine in the bottles in the volume based on differential variations in temperature with time between the air input, air output, and air flow;

means for storing a number of temperature reduction models;

means for selecting one of the temperature reduction models in accordance with predetermined criteria and based on the thermal load;

means for modulating the refrigeration temperature in accordance with the temperature reduction models after the output air temperature reaches a chosen relation to the selected temperature level; and means for repeating the sequence with a new temperature reduction model when the thermal load changes.

* * * * *